US006133223A

United States Patent [19]

Sampaio et al.

[11] Patent Number: 6,133,223

[45] **Date of Patent: *Oct. 17, 2000**

[54] PRODUCTION OF DETERGENT GRANULATES

[75] Inventors: Bernardete Barreto Sampaio; Lazaro Valli, both of Sao Paulo, Brazil

[73] Assignee: Lever Brothers Company, division of Conopco, Inc., New York, N.Y.

[ * ] Notice: This patent is subject to a terminal disclaimer.

[21] Appl. No.: 09/097,336

[22] Filed: Jun. 15, 1998

[30] Foreign Application Priority Data

Jun. 27, 1997 [GB] United Kingdom ..... 9713748

[51] Int. Cl.[7] ..... C11D 11/00; C11D 3/10

[52] U.S. Cl. ..... 510/444; 510/495; 510/509; 510/536; 23/313 R; 23/313 FB; 264/117; 562/115

[58] Field of Search ..... 510/444, 438, 510/445, 495, 509, 536; 23/313 R, 313 FB; 264/117; 562/115

[56] References Cited

U.S. PATENT DOCUMENTS

| | | | |
|---|---|---|---|
| 4,153,625 | 5/1979 | Barton et al. | 260/457 |
| 4,219,589 | 8/1980 | Niks et al. | 427/213 |
| 4,430,271 | 2/1984 | Barton et al. | 260/458 R |
| 4,619,843 | 10/1986 | Mutsers | 427/213 |
| 4,701,353 | 10/1987 | Mutsers et al. | 427/213 |
| 4,734,224 | 3/1988 | Barrett et al. | 510/452 |
| 4,894,177 | 1/1990 | Starch | 510/438 |
| 4,919,847 | 4/1990 | Barletta et al. | 510/442 |
| 5,516,447 | 5/1996 | Bauer et al. | 252/89.1 |
| 5,573,697 | 11/1996 | Riddick et al. | 510/359 |
| 5,629,275 | 5/1997 | Bauer et al. | 510/108 |
| 5,633,224 | 5/1997 | Porter | 510/444 |
| 5,739,097 | 4/1998 | Bauer et al. | 510/446 |
| 5,929,021 | 7/1999 | Dhannka et al. | 510/444 |

FOREIGN PATENT DOCUMENTS

| | | |
|---|---|---|
| 304 192 | 2/1989 | European Pat. Off. . |
| 164 514 | 6/1989 | European Pat. Off. . |
| 345090 | 12/1989 | European Pat. Off. . |
| 353 976 | 2/1990 | European Pat. Off. . |
| 353976 | 2/1990 | European Pat. Off. . |
| 367 339 | 5/1990 | European Pat. Off. . |
| 384 070 | 8/1990 | European Pat. Off. . |
| 390 251 | 10/1990 | European Pat. Off. . |
| 420 317 | 4/1991 | European Pat. Off. . |
| 555 622 | 8/1993 | European Pat. Off. . |
| 140 987 | 4/1980 | Germany . |
| 140 987 | 9/1980 | Germany . |
| 255 833 | 4/1988 | Germany . |
| 42 32 874 | 3/1994 | Germany . |
| 43 04 015 | 8/1994 | Germany . |
| 43 04 062 | 8/1994 | Germany . |
| 44 43 644 | 6/1996 | Germany . |
| 166 307 | 4/1990 | India . |
| 166307 | 4/1990 | India . |
| 88903 | 6/1986 | Romania . |
| 707994 | 4/1954 | United Kingdom . |
| 748780 | 5/1956 | United Kingdom . |
| 953655 | 3/1964 | United Kingdom . |
| 1 341 557 | 12/1973 | United Kingdom . |
| 1341557 | 12/1973 | United Kingdom . |
| 1 437 950 | 6/1976 | United Kingdom . |
| 1 470 250 | 4/1977 | United Kingdom . |
| 1 473 201 | 5/1977 | United Kingdom . |
| 1 473 202 | 5/1977 | United Kingdom . |
| 2 209 172 | 5/1989 | United Kingdom . |
| 90/01536 | 2/1990 | WIPO . |
| 93/04154 | 3/1993 | WIPO . |
| 93/19151 | 9/1993 | WIPO . |
| 93/23520 | 11/1993 | WIPO . |
| 94/03267 | 2/1994 | WIPO . |
| 94/07990 | 4/1994 | WIPO . |
| 94/24260 | 10/1994 | WIPO . |
| 95/00630 | 1/1995 | WIPO . |
| 95/25158 | 9/1995 | WIPO . |
| 96/03485 | 2/1996 | WIPO . |
| 96/04359 | 2/1996 | WIPO . |
| 97/22685 | 6/1997 | WIPO . |
| 97/28246 | 8/1997 | WIPO . |
| 98/14549 | 4/1998 | WIPO . |
| 98/14550 | 4/1998 | WIPO . |
| 98/14551 | 4/1998 | WIPO . |
| 98/14552 | 4/1998 | WIPO . |
| 98/14553 | 4/1998 | WIPO . |
| 98/14554 | 4/1998 | WIPO . |
| 98/14555 | 4/1998 | WIPO . |
| 98/14556 | 4/1998 | WIPO . |
| 98/14557 | 4/1998 | WIPO . |
| 98/14558 | 4/1998 | WIPO . |
| 98/58046 | 12/1998 | WIPO . |
| 98/58047 | 12/1998 | WIPO . |
| 98/58048 | 12/1998 | WIPO . |
| 99/00475 | 1/1999 | WIPO . |
| 99/03964 | 1/1999 | WIPO . |
| 99/03966 | 1/1999 | WIPO . |
| 99/03967 | 1/1999 | WIPO . |

OTHER PUBLICATIONS

Watano et al., "Scale–Up of Agitation Fluidized Bed Granulation I. Preliminary Experimental Approach for Optimization of Process Variables", Chem. Pharm. Bull., vol. 43 (No. 7), Parts I–IV, pp. 1212–1230, 1995.

Schaefer et al., "Control of Fluidized Bed Granulation", Arch. Pharm. Chemi. Sci., Ed. 5, pp. 51–60, 1977.

*Primary Examiner*—Lorna M. Douyon
*Attorney, Agent, or Firm*—Rimma Mitelman

[57] ABSTRACT

A granular detergent product is made by contacting a liquid binder and a solid neutralizing agent. The binder has an acidic component comprising an anionic surfactant acidic precursor and an inorganic acid. The inorganic acid is at least 2.5% by weight of the acidic component. The neutralizing agent and at least some of the binder are granulated in a low-shear granulator.

16 Claims, No Drawings

PRODUCTION OF DETERGENT GRANULATES

The present invention relates to a process for the production of detergent compositions having a reduced bulk density (BD) and compositions formed by that process.

It is long known in the art to obtain detergent powders by spray-drying. However, the spray-drying process is both capital and energy intensive and consequently the resultant product is expensive.

More recently, there has been much interest in production of granular detergent products by processes which employ mainly mixing, without the use of spray-drying. These mixing techniques can offer great flexibility in producing powders of various different compositions from a single plant by post-dosing various components after an initial granulation stage.

A known kind of mixing process, which does not involve spray-drying, employs a moderate speed granulator (a common example often colloquially being called a "ploughshare"), optionally preceded by a high speed mixer (a common example often colloquially being called a "recycler" due to its recycling cooling system). Typical examples of such processes are described in our European patent specifications EP-A-367 339, EP-A-390 251 and EP-A-420 317. These moderate speed and high speed mixers exert relatively high levels of shear on the materials being processed.

Until recently, there has been less effort in developing use of low-shear mixers or granulators. One type of low-shear equipment is a gas fluidisation granulator. In this kind of apparatus, a gas (usually air) is blown through a body of particulate solids onto which is sprayed a liquid component.

A gas fluidisation granulator is sometimes called a "fluidised bed" granulator or mixer. However, this is not strictly accurate since such mixers can be operated with a gas flow rate so high that a classical "bubbling" fluid bed does not form.

Although low-shear granulations can give good control of bulk density, there is still a need for greater flexibility and in particular, for producing lower BD powders. Processes involving low-shear granulation are quite varied.

Indian Patent No. 166307 (Unilever) describes use of an internal recirculating fluidised bed and explains that use of a conventional fluidised bed will lead to a lumpy and sticky process.

East German Patent No. 140 987 (VEB Waschmittelwerk) discloses a continuous process for the production of granular washing and cleaning compositions, wherein liquid components such as nonionic surfactants or the acid precursors of anionic surfactants are sprayed onto a fluidised powdered builder material, especially sodium tripolyphosphate (STP) having a high phase II content to obtain a product with bulk density ranging from 530–580 g/l.

WO96/04359 (Unilever) discloses a process whereby low bulk density powders are prepared by contacting a neutralising agent such as an alkaline detergency builder and a liquid acid precursor of an anionic surfactant in a fluidisation zone to form detergent granules.

We have now found that incorporation of an inorganic acid with the liquid acid precursor of an anionic surfactant enables the bulk density to be reduced. Thus, the present invention provides a process for the production of a granular detergent product, the process comprising bringing into contact a liquid binder and a powdered and/or granular solid neutralising agent, the liquid binder comprising an acidic component comprising an acid precursor of an anionic surfactant and an inorganic acid, wherein the amount of the inorganic acid is at least 2.5 wt % of the acidic component and the neutralising agent and liquid binder are brought into contact and granulated in a low shear granulator.

We have also found that granular detergent products produced by the process of the present invention can have improved dissolution rates in wash liquor.

Preferably, in the process according to the present invention, the low shear granulator is of the gas fluidisation type and comprises a fluidisation zone in which the liquid binder is sprayed into or onto the solid neutralising agent. However, a bowl mixer/granulator can also be used. When the low shear granulator is of the gas fluidisation kind it may sometimes be preferable to use equipment of the kind provided with a vibrating bed.

In the context of the present invention, the term "granular detergent product" encompasses granular finished products for sale, as well as granular components or adjuncts for forming finished products, e.g. by post-dosing to or with further components or adjuncts or any other form of admixture. The minimum requirement is that it should contain an anionic surfactant and a salt of an inorganic acid. It may also contain one or more of a builder, a bleach or bleach-system component, an enzyme, an enzyme stabiliser or component of an enzyme stabilising system, a soil anti-redeposition agent, an optical brightening agent (fluorescer), an anti-corrosion agent, and anti-foam material, a perfume or a colourant.

As used herein, the term "powder" refers to materials substantially consisting of grains of individual materials and mixtures of such grains. The term "granule" refers to a small particle of agglomerated powder materials. The final product of the process according to the present invention consists of, or comprises a high percentage of, granules. However, additional granular and/or powder materials may optionally be post-dosed to such a product. Moreover, as will be explained in more detail hereinbelow, the solid neutralising agent of the present invention may be powdered and/or granular.

The process of the present invention may be carried out in either batch or continuous mode of operation as desired.

Whether the process of the present invention is a batch or a continuous process, the solid neutralising agent may be introduced at any time during the time when liquid binder is being introduced. In the simplest form of the process, the solid neutralising agent is first introduced to the low-shear granulator and then sprayed with the liquid binder. However, some solid neutralising agent could be introduced at the beginning of the processing in the low-shear granulator and the remainder introduced at one or more later times, either as one or more discrete batches or in continuous fashion.

If the low-shear granulator is of the gas fluidisation kind, then the liquid binder can be sprayed from above and/or below and/or within the midst of the fluidised material comprising the solid neutralising agent.

The invention also encompasses a detergent composition obtainable by a process according to the present invention.

The inorganic acid constitutes at least 2.5 wt % of the acidic component of the liquid binder. It will be appreciated that some commercially available acid anionic surfactant precursors contain minor amounts of inorganic acid impurities. Preferably though, the amount of the inorganic acid in the acidic component is at least 5 wt %, for example, at least 8.5 wt %, more preferably at least 10 wt %, still more preferably at least 15 wt % and most preferably at least 20 wt %.

It is also preferable that the inorganic acid should not exceed 50 wt % of the acidic component, more preferably not exceeding 40 wt %, most preferably not exceeding 30 wt %.

As well as the acidic component, the liquid binder may contain one or more other liquid materials such as liquid nonionic surfactants and organic solvents. The total amount of acidic component will normally be as high as possible, subject to the presence of any other components in the liquid and subject to other considerations referred to below. Thus, the acidic component may constitute at least 98 wt % (say, at least 95%) of the liquid binder, but could be at least 75 wt %, at least 50 wt % or at least 25 wt %.

When liquid nonionic surfactant is present in the liquid binder, then the weight ratio of all acid precursor(s) of anionic surfactant(s) to nonionic surfactants, will normally be from 20:1 to 1:20. However, this ratio may be, for example, 15:1 or less (of the anionic), 10:1 or less, or 5:1 or less. On the other hand, the nonionic may be the major component so that the ratio is 1:5 or more (of the nonionic), 1:10 or more, or 1:15 or more. Ratios in the range from 5:1 to 1:5 are also possible.

In the manufacture of granules according to the process of the present invention, sometimes it is desirable not to incorporate all of the anionic surfactant by neutralisation of an acid precursor. Some can optionally be incorporated in the alkali metal salt form, dissolved in the liquid binder or else as part of the solids. In that case, the maximum amount of anionic surfactant incorporated in the salt form (expressed as the weight percentage of the total anionic surfactant salt in the product output from the low shear granulator) is preferably no more than 70%, more preferably no more than 50% and most preferably no more than 40%.

In the manufacture of granules according to the process of the present invention, it is desirable not to incorporate all of the inorganic acid salt by neutralisation of the inorganic acid. Preferably, some of the inorganic acid salt is incorporated in the alkali metal salt form, for example, sodium sulphate, dissolved in the liquid binder or else as part of the solids. The maximum amount of inorganic alkali metal salt incorporated via neutralisation of the inorganic acid (expressed as the weight percentage of the total inorganic acid salt in the product output from the low shear granulator) is preferably no more than 50%, more preferably no more than 40% and most preferably no more than 30%.

If it is desired to incorporate a soap in the granules, this can be achieved by incorporating a fatty acid, either in solution in the liquid binder or as part of the solids. The solids in any event must comprise an inorganic alkaline neutralising agent to react with the fatty acid to produce the soap.

The liquid binder will often be totally or substantially non-aqueous, that is to say, any water present does not exceed 25 wt % of the liquid binder, but preferably no more than 10 wt %. However, if desired, a controlled amount of water may be added to facilitate neutralisation. The water may be added in amounts of 0.5 to 3 wt % by weight of the final detergent composition. Any such water is suitably added prior to or together or alternating with the addition of the acidic component of the liquid binder.

In a refinement of the process of the present invention, the neutralising agent may be contacted and mixed with a first portion of the liquid binder, e.g. in a low-, moderate- or high-shear mixer (i.e. pre-mixer) to form a partially granulated material. The latter can then be sprayed with a second portion of the liquid binder in the low-shear granulator, to form the granulated detergent product.

In such a two-stage granulation process, it is preferred, but not absolutely necessary, for the total of liquid binder to be dosed only in the partial granulation pre-mixer and low-shear granulation steps. Conceivably, some could be dosed before the partial granulation pre-mixing and/or other earlier processing steps. Also, the content of the liquid binder (e.g. the inorganic acid content) could be varied between the first and second stages.

The extent of granulation in the pre-mixer (i.e. partial granulation) and the amount of granulation in the low-shear granulator is preferably determined in accordance with the final product density desired. The preferred amounts of liquid binder to be dosed at each of the two stages may be varied thus:

(i) If a lower powder density is desired, i.e., 350–650 g/l
  (a) 5–75 wt % of total liquid binder is preferably added in the pre-mixer; and
  (b) the remaining 95–25 wt % of total liquid binder is preferably added in the low shear-granulator.

(ii) If a higher powder density is desired, i.e., 550–1300 g/l
  (a) 75–95 wt % of total liquid binder is added in the pre-mixer; and
  (b) the remaining 5–25 wt % of total liquid binder is added in the low-shear granulator.

Whether or not an initial pre-mixer is used for partial granulation, particulate material comprising the solid neutralising agent and optionally, other components, may be introduced into the low-shear granulator and the required amount of liquid binder is then introduced, preferably by spraying, onto the said material, preferably from above.

If an initial pre-mixer is used for partial granulation, an appropriate mixer for this step is a high-shear Lodige® CB machine or a moderate-speed mixer such as a Lodige® KM machine. Other suitable equipment includes Drais® T160 series manufactured by Drais Werke GmbH, Germany; the Littleford mixer with internal chopping blades and turbine-type miller mixer having several blades on an axis of rotation. A low- or high-shear mixer granulator has a stirring action and/or a cutting action which are operated independently of one another. Preferred types of low- or high-shear mixer granulators are mixers of the Fukae® FS-G series; Diosna® V series ex Dierks & Sohne, Germany; Pharma Matrix® ex T. K. Fielder Ltd; England. Other mixers believed to be suitable for use in the process of the invention are Fuji® VG-C series ex Fuji Sangyo Co., Japan; the Roto® ex Zanchetta & Co. srl, Italy and Schugi® Flexomix granulator. Yet another mixer suitable for use in a pre-granulation stage is the Lodige (Trade Mark) FM series (ploughshare mixers) batch mixer ex Morton Machine Co. Ltd., Scotland.

If a gas fluidisation granulator is used as the low-shear granulator, then preferably it is operated at a superficial air velocity of about 0.1–1.2 $ms^{-1}$, either under positive or negative relative pressure and with an air inlet temperature ranging from −10° or 5° C. up to 80° C., or in some cases, up to 200° C. An operational temperature inside the bed of from ambient temperature to 60° C. is typical.

The low-shear granulator used in the process of the present invention may be adapted to recycle "fines", i.e. powdered or part-granular material of very small particle size, so that they are returned to the input of the low shear granulator and/or input of any pre-mixer/granulator. Preferably the fine particulates are elutriated material, e.g. they are present in the air leaving a gas fluidisation chamber.

Optionally, a "layering agent" or "flow aid" may be introduced with the starting materials at any appropriate stage. This is to improve the granularity of the product, e.g.

by preventing aggregation and/or caking of the granules. Any layering agent/flow aid is suitably present in an amount of 0.1 to 15 wt % of the detergent composition and more preferably in an amount of 0.5 to 5 wt %.

Suitable flow aids include crystalline or amorphous alkali metal silicates, aluminosilicates including zeolites, Dicamol, calcite, diatomaceous earth, silica, for example precipitated silica, chlorides such as sodium chloride, sulphates such as magnesium and sodium sulphate, carbonates such as calcium carbonate and phosphates such as sodium tripolyphosphate. Mixtures of these materials may be employed as desired.

In general, additional components may be included in the liquid binder or admixed with the solid neutralising agent at an appropriate stage of the process. However, solid components can be post-dosed to the granular detergent product.

The process of the invention utilises neutralisation of the acidic component of the liquid binder, including the acid precursor of an anionic surfactant and an inorganic acid, with a neutralising agent by fluidisation of the neutralising agent, optionally after partial pre-granulation of the neutralising agent with some of the liquid binder. Preferably, addition of the liquid binder is controlled so that it does not accumulate in the unneutralised form in the final product.

The acid precursor of the acidic component may for example be the acid precursor of a linear alkylbenzene sulphonate (LAS) or primary alkyl sulphate (PAS) anionic surfactant or of any other kind of anionic surfactant.

The inorganic acid of the acidic component may be any which is compatible with the anionic surfactant precursor. Preferred is sulphuric acid. However, other suitable inorganic acids include, for example, citric acid and hydrochloric acid.

The neutralising agent is suitably particulate and comprises an alkaline inorganic material, preferably an alkaline salt. Suitable materials include alkali metal carbonates and bicarbonates for example sodium salts thereof.

The neutralising agent is very preferably present at a level sufficient to neutralise fully the acidic component. If desired, a stoichiometric excess of neutralising agent may be employed to ensure complete neutralisation or to provide an alternative function, for example as a detergency builder, e.g. if the neutralising agent comprises sodium carbonate.

In addition to the anionic surfactant obtained by the neutralisation step, further anionic surfactants or nonionic surfactants as mentioned above, also cationic, zwitterionic, amphoteric or semipolar surfactants and mixtures thereof may be added at a suitable time. In general, suitable surfactants include those generally described in "Surface active agents and detergents" Vol I by Schwartz and Perry. If desired, soap derived from saturated or unsaturated fatty acids having, for example, $C_{10}$ to $C_{18}$ carbon atoms may also be present.

The detergent active is suitably present at a level of 5 to 40 wt %, preferably 10 to 30 wt % of the final granular detergent product.

A complete detergent composition often contains a detergency builder. Such a builder may be introduced with the neutralising agent and/or added subsequently as desired. Preferably, the builder is introduced with the neutralising agent.

Generally speaking, the total amount of detergency builder in the granular detergent product is suitably from 10 to 80 wt %, preferably 15 to 65 wt % and more preferably 15 to 50 wt %.

Inorganic builders that may be present include sodium carbonate, if desired in combination with a crystallisation seed for calcium carbonate, as disclosed in GB 1 437 950. Any sodium carbonate will need to be in excess of any used to neutralise the anionic acid precursor if the latter is added.

Other suitable builder include crystalline and amorphous aluminosilicates, for example, zeolites as disclosed in GB 1 473 201, amorphous aluminosilicates as disclosed in GB 1 473 202 and mixed crystalline/amorphous aluminosilicates as disclosed in GB 1 470 250; and layered silicates as disclosed in EP 164 514B. Inorganic phosphate builders, for example, sodium orthophosphate, pyrophosphate and tripolyphosphate, may also be present.

Aluminosilicates, whether used as layering agents and/or incorporated in the bulk of the particles may suitably be present in a total amount of from 10 to 60 wt % and preferably an amount of from 15 to 50 wt % of the granular detergent product. The zeolite used in most commercial particulate detergent compositions is zeolite A. Advantageously, however, maximum aluminium zeolite P (zeolite MAP) described and claimed in EP 384 070 may be used. Zeolite MAP is an alkali metal aluminosilicate of the P type having a silicon to aluminium ratio not exceeding 1.33, preferably not exceeding 1.15, and more preferably not exceeding 1.07.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts. A copolymer of maleic acid, acrylic acid and vinyl acetate is especially preferred as it is biodegradable and thus environmentally desirable. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %. Citrates can also be used at lower levels (e.g. 0.1 to 5 wt %) for other purposes. The builder is preferably present in alkali metal salt, especially sodium salt form.

Suitably, the builder system may comprise a crystalline layered silicate, for example, SKS-6 ex Hoechst, a zeolite, for example, zeolite A and optionally an alkali metal citrate.

The builder and neutralising agent may be the same material, for example sodium carbonate, in which case sufficient material will be employed for both functions.

Detergent compositions according to the invention may also suitably contain a bleach system. Fabric washing compositions may desirably contain peroxy bleach compounds, for example, inorganic persalts or organic peroxyacids, capable of yielding hydrogen peroxide in aqueous solution.

Detergent powder obtained by the present invention suitably has a low bulk density in the range 350 to 650 g/l, or 450 to 650 g/l, for example, in the proximity of 500 g/l and is thus comparable to a bulk density obtained by the method of spray-drying.

The composition may also comprise a particulate filler which suitably comprises an inorganic salt, for example sodium sulphate and sodium chloride. The filler may be present at a level of 5 to 60% by weight of the composition.

A fully formulated detergent composition produced according to the invention might for example comprise the detergent active and builder and optionally one of more of a flow aid, a filler and other minor ingredients such as colour, perfume, fluorescer, bleaches, enzymes.

The invention will now be illustrated by the following non-limiting examples:

EXAMPLES

Example 1

This example illustrates the effect of increasing the levels of sulphuric acid in the liquid binder on the bulk density of a granular detergent product.

Liquid binder solutions comprising various ratios of linear alkyl benzene sulphonic acid (LAS), water (in this case present to facilitate neutralisation) and sulphuric acid were prepared as indicated in Table 1. The liquid binder solutions were then sprayed onto particulate material in a fluidised bed apparatus at a temperature of 45° C.–50° C. The particulate material comprised sodium carbonate as neutralising agent, added in excess to cope with the alternative function as a builder, and other materials such as sodium tripolyphosphate (STP), zeolite (as a flow aid), sodium sulphate (as a filler) and minors such as fluorescer and anti-redeposition agent (SCMC). Fluid bed granulation effected the formation of neutralised acids and the production of a free flowing granular detergent product.

Tests 2 and 3 demonstrated a significant reduction in the bulk density of the detergent product when sulphuric acid was present in the liquid binder. As the level of sulphuric acid was increased, and consequently the level of in situ formed sodium sulphate was increased, the bulk density of the detergent product decreased.

TABLE 1

| | Test 1 | Test 2 | Test 3 |
|---|---|---|---|
| Liquid binder (wt %) | | | |
| . LAS | 92.15 | 86.14 | 73.72 |
| . Sulphuric Acid | 1.14 | 7.37 | 20.63 |
| . Water | 5.5 | 5.29 | 4.63 |
| . Impurities | 1.14 | 1.20 | 1.03 |
| Final Composition (wt %) | | | |
| NaLAS | 15.00 | 15.00 | 15.00 |
| Sodium Carbonate | 25.50 | 25.50 | 25.50 |
| STP | 2.26 | 2.26 | 2.26 |
| In Situ Sodium Sulphate | 0.27 | 1.31 | 4.00 |
| Sodium Sulphate | 48.73 | 47.14 | 42.93 |
| Water | 2.49 | 2.97 | 4.21 |
| Zeolite (100% AI) | 4.89 | 4.89 | 4.89 |
| Minors, impurities | 0.86 | 0.93 | 1.21 |
| Bulk Density (g/l) | 711 | 667 | 615 |

Example 2

This example illustrates the effect of increasing the levels of sulphuric acid in the liquid binder on the bulk density and the rate of dissolution (ROD) of a granular detergent products.

Liquid binder solutions comprising various ratios of linear alkyl benzene sulphonic acid (LAS), water (in this case present to facilitate neutralisation) and sulphuric acid were prepared as indicated in Table 2. The liquid binder solutions were sprayed onto particulate material and fluid bed granulation performed as described in Example 1 to produce free flowing granular detergent compositions.

In Test 6, the sodium carbonate monohydrate was preformed by adding an amount of water corresponding to 17 wt % of the sodium carbonate in the detergent formulation.

TABLE 2

| | Test 4 | Test 5 | Test 6 |
|---|---|---|---|
| Liguid binder (wt %) | | | |
| . LAS | 85.17 | 82.45 | 82.45 |
| . Sulphuric Acid | 5.83 | 15.81 | 15.81 |
| . Water | 7.16 | 0.725 | 0.725 |
| . Impurities | 1.84 | 1.02 | 1.02 |
| Final Composition (wt %) | | | |
| NaLAS | 15.00 | 15.00 | 15.00 |
| Sodium Carbonate | 25.50 | 24.35 | 25.72 |
| STP | 2.26 | 2.26 | 2.26 |
| In Situ Sodium Sulphate | 1.07 | 2.77 | 2.77 |
| Sodium Sulphate | 47.43 | 47.5 | 41.28 |
| Water | 2.82 | 2.33 | 7.19 |
| Zeolite (100% AI) | 4.89 | 4.93 | 4.93 |
| Minors, impurities | 1.03 | 0.86 | 0.85 |
| Bulk Density (g/l) | 650 | 590 | 570 |
| * ROD (%) | | | |
| . 20 seconds | 70 | 73 | 73 |
| . 30 seconds | 79 | 84 | 82 |

*Rate of Dissolution

Tests 4, 5 and 6 confirmed the findings of Example 1 that a significant reduction in the bulk density of the detergent product was achieved by incorporating sulphuric acid in the liquid binder and neutralising it in situ.

The rate of dissolution of the detergent products was determined by adding detergent composition to 500 ml of water to provide a 5% (w/v) concentration, mixing at 100 rpm and measuring the conductivity of the solution until a constant reading was reached.

Comparing Tests 5 and 6 with Test 4, an increase in the ROD was observed when the level of sulphuric acid in the liquid binder was increased from 5.83 wt % to 15.81 wt %.

The dissolution behaviour and foam production qualities of the detergent compositions from Tests 4, 5, and 6 were assessed by 30 internal panellists. A bowl was filled with 16 l of water and 50 g of detergent composition added. The solution was agitated for 15 seconds, simulating a normal hand wash process, in order to provide a condition for the product to dissolve. At this stage a measurement was made of residues and foam. A soiled load was then added to the solution and soaked for 15 minutes. The level of residues are assessed again. Soaking was followed by a scrubbing procedure after which the level of residues was reassessed. Finally, the wash was completed by two rinsings.

The panellists assessed the residue and foam level by giving a score between 0 to 10. A control spray-dried composition was also assessed for comparative purposes. The spray-dried composition comprised 24% NaLAS, 14.5% STP, 17.5% sodium carbonate, 8% alkaline sodium silicate, 6.5% moisture and 29.5% sodium sulphate. The bulk density was 460 g/l and the powder had a rate of dissolution of more than 90% in 30 seconds.

The data generated was statistically treated and the results presented in Table 3 reflect a degree of confidence of 95%.

TABLE 3

| | | | | |
|---|---|---|---|---|
| Residues: 15 sec | T6 3.77 | T5 3.91 | C 3.91 | T4 5.79 |
| Amount of foam | T4 5.93 | T6 7.02 | T5 7.06 | C 7.95 |

TABLE 3-continued

| | | | | |
|---|---|---|---|---|
| Residues: 15 min | T6 0.76 | T5 0.96 | C 1.16 | T4 1.49 |
| Residues: end | T6 0.58 | T5 0.60 | C 0.69 | T4 0.70 |

Products: C - control spray-dried composition
T4 - test 4
T5 - Test 5
T6 - Test 6

There was a significant improvement in the rate of dissolution at 15 seconds of the detergent compositions Test 5 and Test 6 compared with Test 4. The dissolution at 15 seconds of Test 5 and Test 6 was comparable with the spray-dried composition.

The improvement on dissolution rate is manifested in the increase in lather. The products from Test 5 and Test 6 were superior than Test 4.

The advantages of the products from Test 5 and Test 6 in comparison to Test 4 decreased over the duration of the wash process, as demonstrated by the measurements made at 15 minutes and the end of the wash. However, the superior dissolution rate during the first moments of the wash are very important because this is when the consumers really perceive and judge the attribute.

What is claimed is:

1. A process for the production of a granular detergent product having a bulk density in the range of 350–650 g/liter comprising bringing into contact a liquid binder and a powdered and/or granular solid neutralizing agent, the liquid binder comprising an acidic component comprising an acid precursor of an anionic surfactant and an inorganic acid, and at most 25% of water by weight of the liquid binder wherein the amount of the inorganic acid is at least 15 wt % of the acidic component and the neutralizing agent and liquid binder are brought into contact and granulated in a low-shear granulator.

2. A process according to claim 1, wherein the low-shear granulator is a gas fluidization granulator.

3. A process according to claim 1, wherein the amount of the inorganic acid is no more than 50% by weight of the acidic component.

4. A process according to claim 1, wherein the solid neutralizing agent comprises an alkaline inorganic material.

5. A process according to claim 4 wherein the alkaline inorganic material is an alkali metal salt.

6. A process according to claim 5, wherein the alkali metal salt is a carbonate or a bicarbonate salt.

7. The process according to claim 6 wherein the alkali metal salt is sodium carbonate or sodium bicarbonate.

8. A process according to claim 1, wherein the neutralizing agent is present at a level at least sufficient to neutralize fully the acidic component.

9. A process for the production of a granular detergent product comprising bringing into contact a liquid binder and a powdered and/or granular solid neutralizing agent, the liquid binder comprising an acidic component comprising an acid precursor of an anionic surfactant and an inorganic acid, wherein the amount of the inorganic acid is at least 2.5 wt % of the acidic component, wherein a first portion of the liquid binder is admixed with the neutralizing agent in a mixer to form a partially granulated material and then the partially granulated material and a second portion of the liquid binder are brought into contact in a low shear granulator to effect complete granulation.

10. A process according to claim 9, wherein the low-shear granulator is a gas fluidization granulator.

11. A process according to claim 9, wherein the amount of the inorganic acid is at least 5% by weight of the acidic component.

12. A process according to claim 9, wherein the amount of the inorganic acid is no more than 50% by weight of the acidic component.

13. A process according to claim 9, wherein the solid neutralizing agent comprises an alkaline inorganic material.

14. A process according to claim 13, wherein the alkaline inorganic material is an alkali metal salt.

15. A process according to claim 14, wherein the alkali metal salt is a carbonate or a bicarbonate salt.

16. A process according to claim 9, wherein the neutralizing agent is present at a level at least sufficient to neutralize fully the acidic component.

* * * * *